US008549733B2

(12) United States Patent
Bedwell et al.

(10) Patent No.: US 8,549,733 B2
(45) Date of Patent: Oct. 8, 2013

(54) METHOD OF FORMING A TRANSDUCER ASSEMBLY

(75) Inventors: Kevin M. Bedwell, Chicago Heights, IL (US); Lajos Frohlich, Forest Park, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 563 days.

(21) Appl. No.: 12/833,639

(22) Filed: Jul. 9, 2010

(65) Prior Publication Data

US 2012/0008804 A1 Jan. 12, 2012

(51) Int. Cl.
*H01F 3/04* (2006.01)
*H01F 7/06* (2006.01)

(52) U.S. Cl.
USPC ..... 29/609.1; 29/417; 29/592.1; 29/595; 29/602.1; 72/464; 156/268; 257/E21.596; 228/181; 228/190; 219/121.69; 219/121.85

(58) Field of Classification Search
USPC ..... 29/417, 592.1, 594, 595, 609.1; 72/464; 156/268, 344; 257/E21.596; 228/181, 190; 219/121.69, 121.85
See application file for complete search history.

(56) References Cited

U.S. PATENT DOCUMENTS 2,325,590 A 8/1943 Carlisle
2,430,229 A 11/1947 Kelsey
2,521,414 A 9/1950 Schier
2,808,468 A 10/1957 Knauert
2,971,065 A 2/1961 Busse
3,068,954 A 12/1962 Strzalkowski
3,265,819 A 8/1966 Herrmann
3,312,789 A 4/1967 Lewis
3,374,318 A 3/1968 Martin
3,491,436 A 1/1970 Carlson
3,529,102 A 9/1970 Rosenstand
3,770,561 A * 11/1973 Kogert ..... 428/390

(Continued)

FOREIGN PATENT DOCUMENTS

DE 2923865 11/1980
DE 3504891 9/1985

(Continued)

OTHER PUBLICATIONS

International Search Report and Written Opinion dated Oct. 13, 2011, for PCT/US2011/042593, 12 pages.

(Continued)

*Primary Examiner* — Paul D Kim
(74) *Attorney, Agent, or Firm* — Banner & Witcoff, Ltd.

(57) ABSTRACT

A transducer and method of forming a transducer is disclosed. The method comprises locating a feed wire for forming a drive pin on a reed surface, welding a first end of the feed wire to the reed, cutting the feed wire to form a drive pin, and securing the drive pin to a paddle. The first end of the feed wire can be welded to the reed by a laser welding operation. The laser melts the reed to form a molten reed material, and the feed wire is pushed through the molten reed material to form a weld between the feed wire and the reed, once the molten reed material solidifies. The wire coil is then cut with a second laser to form the drive pin. The drive pin is then adhered to a paddle with an adhesive.

13 Claims, 9 Drawing Sheets

(56) References Cited

U.S. PATENT DOCUMENTS

| | | | | |
|---|---|---|---|---|
| 3,777,078 | A * | 12/1973 | Boutros-Attia et al. | 381/418 |
| 4,295,066 | A | 10/1981 | Lloyd | |
| 4,311,206 | A | 1/1982 | Johnson | |
| 4,375,016 | A | 2/1983 | Harada | |
| 4,407,389 | A | 10/1983 | Johnson | |
| 4,418,787 | A | 12/1983 | Eggert | |
| 4,420,657 | A | 12/1983 | Larkin | |
| 4,443,668 | A | 4/1984 | Warren | |
| 4,473,722 | A | 9/1984 | Wilton | |
| 4,520,236 | A | 5/1985 | Gauthier | |
| 4,532,649 | A | 7/1985 | Bellafiore | |
| 4,592,370 | A | 6/1986 | Lee | |
| 4,607,720 | A | 8/1986 | Hardt | |
| 4,677,408 | A | 6/1987 | Bastian | |
| 4,706,778 | A | 11/1987 | Topholm | |
| 4,867,267 | A | 9/1989 | Carlson | |
| 4,870,688 | A | 9/1989 | Voroba | |
| 4,870,689 | A | 9/1989 | Weiss | |
| 4,879,750 | A | 11/1989 | Nassler | |
| 4,956,868 | A | 9/1990 | Carlson | |
| 4,969,534 | A | 11/1990 | Kolpe | |
| 4,987,597 | A | 1/1991 | Haertl | |
| 5,002,151 | A | 3/1991 | Oliveira | |
| 5,048,092 | A | 9/1991 | Yamagishi | |
| 5,068,901 | A | 11/1991 | Carlson | |
| 5,131,128 | A | 7/1992 | Bisgaard | |
| 5,193,116 | A | 3/1993 | Mostardo | |
| 5,220,612 | A | 6/1993 | Tibbetts | |
| 5,299,176 | A | 3/1994 | Tibbetts | |
| 5,319,163 | A | 6/1994 | Scott | |
| 5,327,506 | A | 7/1994 | Stites | |
| 5,390,254 | A | 2/1995 | Adelman | |
| D360,691 | S | 7/1995 | Mostardo | |
| D360,948 | S | 8/1995 | Mostardo | |
| D360,949 | S | 8/1995 | Mostardo | |
| D377,796 | S | 2/1997 | Hayashi | |
| 5,610,989 | A | 3/1997 | Salvage | |
| 5,647,013 | A | 7/1997 | Salvage | |
| 5,655,026 | A | 8/1997 | Peters | |
| 5,659,620 | A | 8/1997 | Kuhlman | |
| 5,661,420 | A | 8/1997 | Killion | |
| 5,682,020 | A | 10/1997 | Oliveira | |
| 5,687,244 | A | 11/1997 | Untersander | |
| 5,692,059 | A | 11/1997 | Kruger | |
| 5,708,721 | A | 1/1998 | Salvage | |
| 5,721,783 | A | 2/1998 | Anderson | |
| 5,753,870 | A | 5/1998 | Schlaegel | |
| 5,757,947 | A | 5/1998 | Van Halteren | |
| 5,784,471 | A | 7/1998 | Bebenroth | |
| 5,809,158 | A | 9/1998 | Van Halteren | |
| 5,887,070 | A | 3/1999 | Iseberg | |
| 5,960,093 | A | 9/1999 | Miller | |
| 6,041,131 | A | 3/2000 | Kirchhoefer | |
| 6,078,677 | A | 6/2000 | Dolleman | |
| 6,137,889 | A | 10/2000 | Shennib | |
| 6,205,227 | B1 | 3/2001 | Mahoney | |
| D453,119 | S | 1/2002 | Tsuchikiri | |
| 6,347,149 | B1 | 2/2002 | Bachmann | |
| D468,299 | S | 1/2003 | Boesen | |
| D468,300 | S | 1/2003 | Boesen | |
| D468,301 | S | 1/2003 | Fushimi | |
| 6,563,933 | B1 | 5/2003 | Niederdraenk | |
| 6,658,134 | B1 | 12/2003 | Van Hal | |
| 6,727,789 | B2 | 4/2004 | Tibbetts | |
| D490,399 | S | 5/2004 | Kamo | |
| 6,757,403 | B2 | 6/2004 | Urushibata | |
| 6,853,735 | B2 | 2/2005 | Imahori | |
| 6,909,613 | B2 | 6/2005 | Augustijn | |
| 6,931,142 | B2 | 8/2005 | Fushimi | |
| 7,024,010 | B2 | 4/2006 | Saunders | |
| 7,050,602 | B2 | 5/2006 | Miller | |
| 7,088,839 | B2 | 8/2006 | Geschiere | |
| 7,103,196 | B2 | 9/2006 | Warren | |
| 7,110,565 | B1 | 9/2006 | Engbert | |
| 7,164,776 | B2 | 1/2007 | Miller | |
| 7,190,803 | B2 | 3/2007 | Van Halteren | |
| 7,194,102 | B2 | 3/2007 | Harvey | |
| 7,194,103 | B2 | 3/2007 | Harvey | |
| 7,206,425 | B2 | 4/2007 | Vaudrey | |
| 7,206,428 | B2 | 4/2007 | Geschiere | |
| 7,236,609 | B1 | 6/2007 | Tsangaris | |
| 7,263,195 | B2 | 8/2007 | Harvey | |
| 7,317,806 | B2 | 1/2008 | Harvey | |
| 7,321,664 | B2 | 1/2008 | Van Banning | |
| 7,336,797 | B2 | 2/2008 | Thompson | |
| D567,217 | S | 4/2008 | Kamo | |
| 7,362,878 | B2 | 4/2008 | Miller | |
| 7,412,763 | B2 | 8/2008 | Jiles | |
| 7,415,125 | B2 | 8/2008 | Warren | |
| 7,489,794 | B2 | 2/2009 | Harvey | |
| 7,492,919 | B2 | 2/2009 | Engbert | |
| 7,529,379 | B2 | 5/2009 | Zurek | |
| 7,551,748 | B2 | 6/2009 | Kamo | |
| 7,577,269 | B2 * | 8/2009 | Adelman | 381/417 |
| 2001/0022844 | A1 | 9/2001 | Urushibata | |
| 2004/0151334 | A1 | 8/2004 | Vaudrey | |
| 2006/0034480 | A1 | 2/2006 | Simidian | |
| 2006/0153418 | A1 | 7/2006 | Van Halteren | |
| 2007/0189569 | A1 | 8/2007 | Haapapuro | |
| 2007/0201717 | A1 | 8/2007 | Dyer | |
| 2007/0258616 | A1 | 11/2007 | Tsangaris | |
| 2007/0274558 | A1 | 11/2007 | Lyon | |
| 2007/0291971 | A1 | 12/2007 | Halteren | |
| 2008/0019555 | A1 | 1/2008 | Llamas-Young | |
| 2008/0181443 | A1 | 7/2008 | Harvey | |
| 2008/0240485 | A1 | 10/2008 | Dyer | |
| 2009/0028356 | A1 | 1/2009 | Ambrose | |
| 2009/0041262 | A1 | 2/2009 | Harvey | |
| 2009/0060245 | A1 | 3/2009 | Blanchard | |
| 2009/0116677 | A1 | 5/2009 | Jones | |
| 2009/0147981 | A1 | 6/2009 | Blanchard | |
| 2009/0232341 | A1 | 9/2009 | Pinter | |

FOREIGN PATENT DOCUMENTS

| | | |
|---|---|---|
| GB | 1032548 | 6/1966 |
| GB | 2155276 | 9/1985 |
| GB | 2197158 | 5/1988 |
| GB | 2453434 | 8/2009 |
| NL | 7613904 | 6/1978 |
| WO | 9507014 | 3/1995 |
| WO | 0169963 | 9/2001 |
| WO | 2007038671 | 4/2007 |

OTHER PUBLICATIONS

"Headphones," dated Aug. 21, 2007, retrieved from http://en.wikipedia.org/wiki/Headhpones, retrieved on Sep. 15, 2011, 11 pages.

"Balanced Armature," dated Aug. 21, 2007, retrieved from http://en.wikipedia.org/wiki/File"Bal_Arm.JPG, retrieved on Sep. 15, 2011, 4 pages.

* cited by examiner

METHOD OF FORMING A TRANSDUCER ASSEMBLY

TECHNICAL FIELD

The disclosure herein relates to the field of sound reproduction, more specifically to the field of sound reproduction using an earphone. Aspects of the disclosure relate to earphone drivers and methods of their manufacture for in-ear listening devices ranging from hearing aids to high quality audio listening devices to consumer listening devices. In particular, aspects of this disclosure relate to the assembly of a drive pin to a paddle. Additionally, however, aspects of this disclosure can be implemented for joining two or more components.

BACKGROUND

Personal "in-ear" monitoring systems are utilized by musicians, recording studio engineers, and live sound engineers to monitor performances on stage and in the recording studio. In-ear systems deliver a music mix directly to the musician's or engineer's ears without competing with other stage or studio sounds. These systems provide the musician or engineer with increased control over the balance and volume of instruments and tracks, and serve to protect the musician's or engineer's hearing through better sound quality at a lower volume setting. In-ear monitoring systems offer an improved alternative to conventional floor wedges or speakers, and in turn, have significantly changed the way musicians and sound engineers work on stage and in the studio.

Moreover, many consumers desire high quality audio sound, whether they are listening to music, DVD soundtracks, podcasts, or mobile telephone conversations. Users may desire small earphones that effectively block background ambient sounds from the user's outside environment.

Hearing aids, in-ear systems, and consumer listening devices typically utilize earphones that are engaged at least partially inside of the ear of the listener. Typical earphones have one or more drivers mounted within a housing, which may be of various types including dynamic drivers and balanced armature drivers. Typically, sound is conveyed from the output of the driver(s) through a cylindrical sound port or a nozzle.

BRIEF SUMMARY

The present disclosure contemplates earphone driver assemblies, specifically balanced armature driver assemblies. The earphone driver assemblies can be used in any hearing aid, high quality listening device, or consumer listening device. For example, the present disclosure could be implemented in or in conjunction with the earphone assemblies, drivers, and methods disclosed in application Ser. No. 12/833,651, titled "Earphone Assembly" and application Ser. No. 12/833,683, titled "Earphone Driver and Method of Manufacture," which are herein incorporated fully by reference.

The following presents a simplified summary of the disclosure in order to provide a basic understanding of some aspects. It is not intended to identify key or critical elements of the invention or to delineate the scope of the invention. The following summary merely presents some concepts of the disclosure in a simplified form as a prelude to the more detailed description provided below.

In one exemplary embodiment a method of forming a balanced armature transducer assembly is disclosed. The method comprises locating a feed wire for forming a drive pin on a reed surface at a wire contact point, welding a first end of the feed wire to the reed, cutting the feed wire to form a drive pin, and securing the drive pin to a paddle. The first end of the feed wire can be welded to the reed by a laser welding operation with a first laser. Before the welding operation, the feed wire is compressed by or against a first reed surface to form a buckled portion in the feed wire. The first laser is directed at a second surface of the reed opposite the wire contact point. The first laser then melts a portion of the reed to form a molten reed material, and the feed wire is pushed through the molten reed material to form a weld between the feed wire and the reed once the molten reed material solidifies. The feed wire is then cut with a second laser to form the drive pin, and the second laser forms a bulbous end on the drive pin. The drive pin is then adhered to a paddle with an adhesive at the bulbous end, and the adhesive forms a socket for receiving the bulbous end portion.

In another exemplary embodiment a balanced armature transducer is disclosed. The transducer has an armature having a reed, a drive pin, and a paddle. The paddle is configured to vibrate to produce sound. The drive pin can be welded to the reed and connects the reed to the paddle. The reed has a first surface and a second surface, and the drive pin passes through the reed and protrudes through the first surface and does not protrude through the second surface; however, alternatively the pin may also slightly protrude through the second surface of the reed. A bulbous or ball-shaped end portion of the pin is glued to the paddle, and the glue forms a socket for receiving the ball-shaped end portion. The ball-shaped end portion of the drive pin has a greater diameter than an average diameter of the drive pin.

Another exemplary method comprises placing a feed wire in contact with a reed at a wire contact point, directing a heat source, such as a laser or other high energy source, at the reed adjacent to wire contact point on the reed, melting a portion of the reed under energy from the heat source to form molten material, and pushing the feed wire into the molten material on the reed so as to form a weld between the reed and the feed wire. The method further comprises cutting the feed wire with a second laser to form a drive pin and securing the drive pin to a paddle to form a connection between the reed and the paddle via the drive pin.

BRIEF DESCRIPTION OF THE DRAWINGS

The present disclosure is illustrated by way of example and not limited in the accompanying figures:

FIGS. 6A1-6D1, and 6F1 show close-up cross-sectional views of FIGS. 6A-6D, and 6F.

DETAILED DESCRIPTION OF THE INVENTION

Figure 1A:
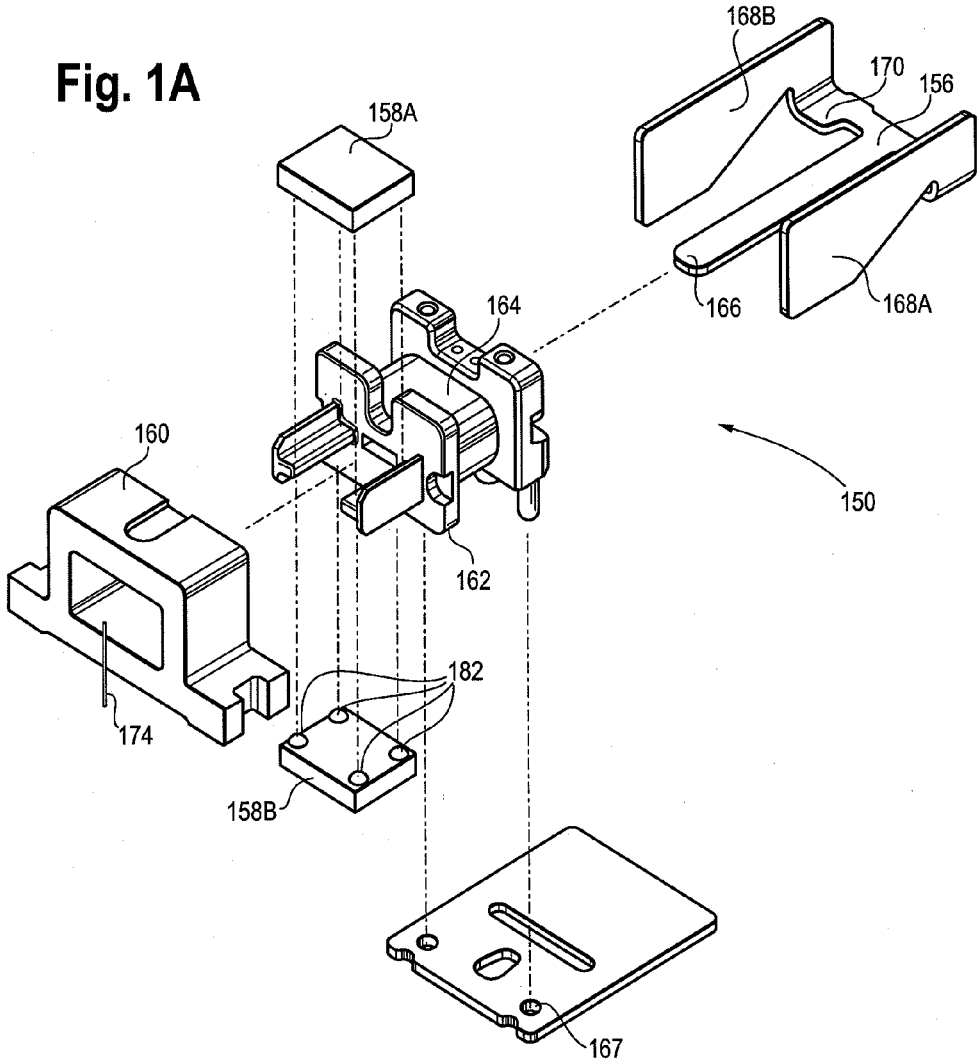
FIG. 1A shows an exploded view of a motor assembly according to an exemplary embodiment.
Figure 1B:
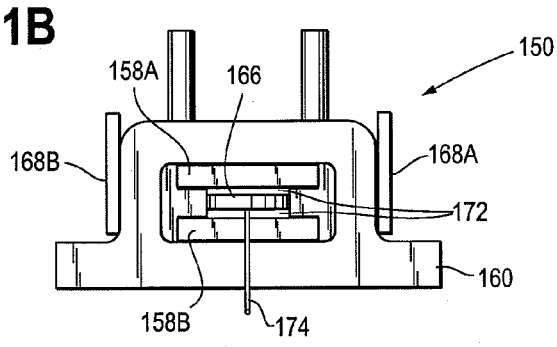
FIG. 1B shows a front view of the motor assembly of FIG. 1A.
Figure 1C:
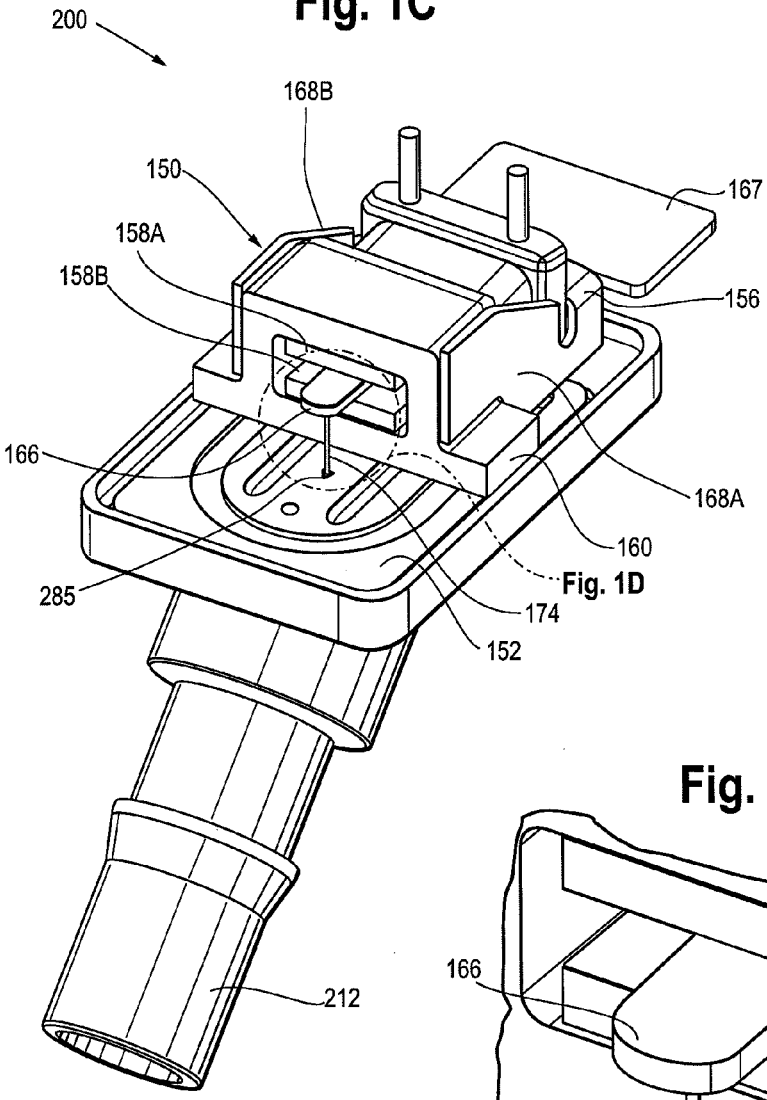
FIG. 1C shows an exemplary nozzle assembly that can be used in conjunction with the motor assembly of FIG. 1A.
Figure 1D:
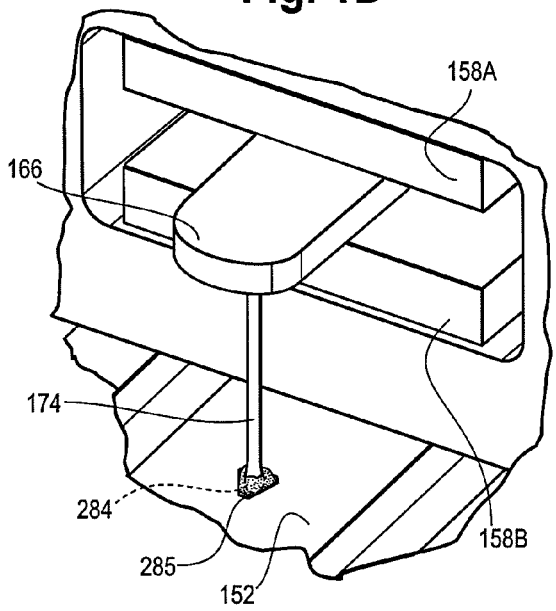
FIG. 1D shows a close-up portion of FIG. 1C.

An exploded view of a balanced armature transducer or motor assembly 150 is shown in FIG. 1A and an assembled view of the motor assembly is shown in FIG. 1B. The balanced armature motor assembly 150 can be used with any earphone ranging from hearing aids to high quality audio listening devices to consumer listening devices. In FIGS. 1C and 1D, the balanced armature motor assembly 150 is shown connected to an exemplary paddle 152 and housing having a nozzle 212.

As shown in FIG. 1A, the motor assembly 150 generally consists of an armature 156, upper and lower magnets 158A, 158B, a pole piece 160, a bobbin 162, a coil 164, a drive pin 174, and a flex board 167. The magnets 158A, 158B can be secured to the pole piece 160 by one or more welds made while the magnets 158A, 158B are held into place by one or more glue dots 182. The flex board 167 is a flexible printed circuit board that mounts to the bobbin 162 and the free ends of the wire forming the coil 164 are secured to the flex board 167.

The armature 156 is generally E-shaped from a top view. In other embodiments, however, the armature 156 may have a U-shape or any other known, suitable shape. The armature has a flexible metal reed 166 which extends through the bobbin 162 and coil 164 between the upper and lower magnets 158A, 158B. The armature 156 also has two outer legs 168A, 168B, lying generally parallel with each other and interconnected at one end by a connecting part 170. As illustrated in FIG. 1B, the reed 166 is positioned within an air gap 172 formed by the magnets 158A, 158B. The two outer armature legs 168A and 168B extend along the outer side along the bobbin 162, coil 164, and pole piece 160. The two outer armature legs 168A and 168B are affixed to the pole piece 160. The reed 166 can be connected to a paddle 152 with the drive pin 174 at the bulbous or ball-shaped end portion 284 by an adhesive 285. The adhesive 285 forms a socket, as depicted in FIG. 1D, around the ball-shaped end portion 284 of the drive pin 174. The drive pin 174 can be formed of stainless steel wire or any other known suitable material.

The electrical input signal is routed to the flex board 167 via a signal cable comprised of two conductors. Each conductor is terminated via a soldered connection to its respective pad on the flex board 167. Each of these pads is electrically connected to a corresponding lead on each end of the coil 164. When signal current flows through the signal cable and into the coil's 164 windings, magnetic flux is induced into the soft magnetic reed 166 around which the coil 164 is wound. The signal current polarity determines the polarity of the magnetic flux induced in the reed 166. The free end of the reed 166 is suspended between the two permanent magnets 158A, 158B. The magnetic axes of these two permanent magnets 158A, 158B are both aligned perpendicular to the lengthwise axis of the reed 166. The lower face of the upper magnet 158A acts as a magnetic south pole while the upper face of the lower magnet 158B acts as a magnetic north pole.

As the input signal current oscillates between positive and negative polarity, the free end of the reed 166 oscillates its behavior between that of a magnetic north pole and south pole, respectively. When acting as a magnetic north pole, the free end of the reed 166 repels from the north-pole face of the lower magnet 158B and attracts to the south-pole face of the upper magnet 158A. As the free end of the reed 166 oscillates between north and south pole behavior, its physical location in the air gap 172 oscillates in kind, thus mirroring the waveform of the electrical input signal. The motion of the reed 166 by itself functions as an extremely inefficient acoustic radiator due to its minimal surface area and lack of an acoustic seal between its front and rear surfaces. In order to improve the acoustic efficiency of the motor, the drive pin 174 is utilized to couple the mechanical motion of the free end of the reed 166 to an acoustically sealed, lightweight paddle 152 of significantly larger surface area. The resulting acoustic volume velocity is then transmitted through the earphone nozzle 212 and ultimately into the user's ear canal, thus completing the transduction of the electrical input signal into the acoustical energy detected by the user.

Figure 2A:
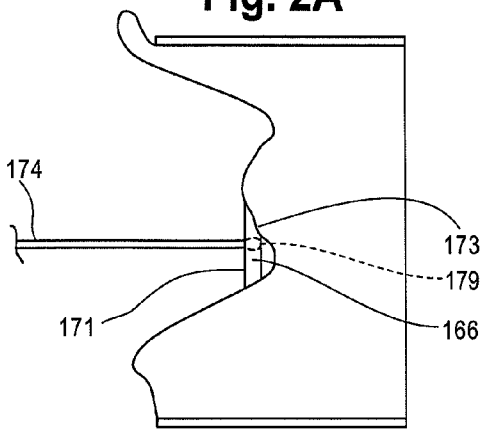
FIGS. 2A-2C show perspective views of a drive pin secured to a reed according to an exemplary embodiment.
Figure 2B:
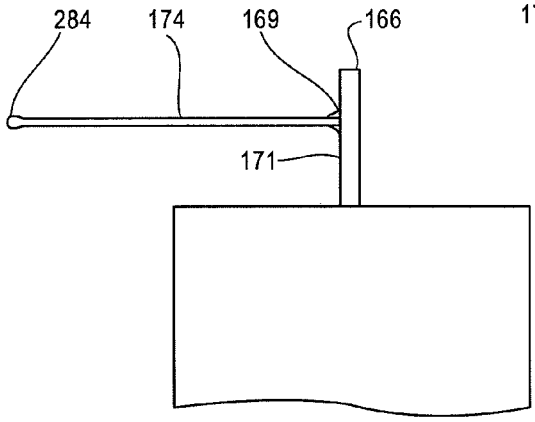
Figure 2C:
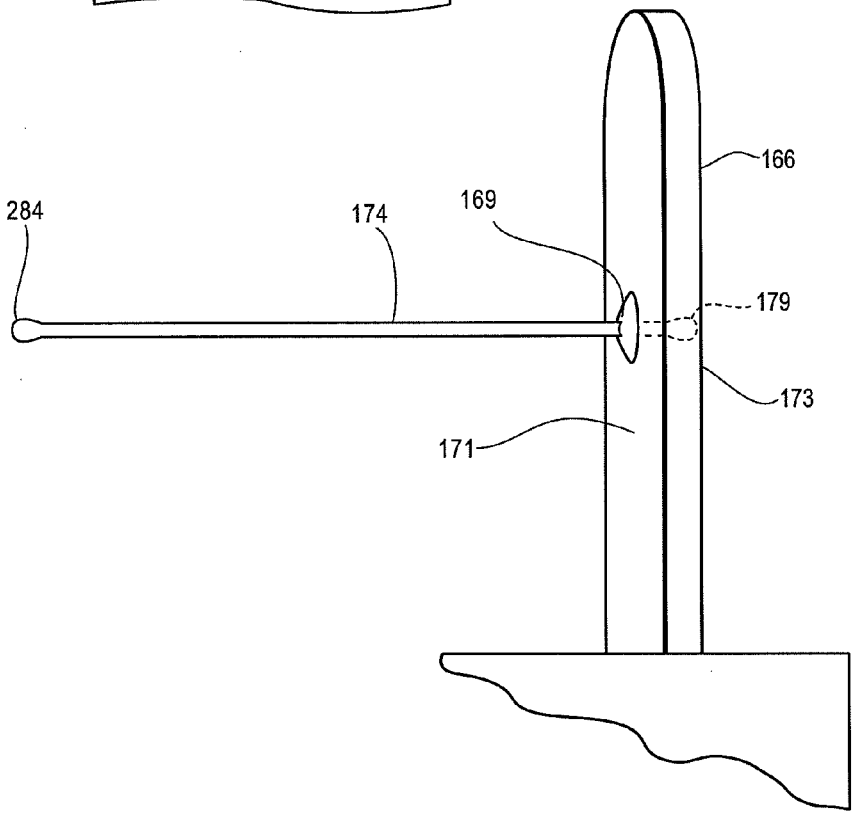

FIGS. 2A-2C depict a close-up view of the drive pin 174 secured to the reed 166. The drive pin 174 can be secured to the reed 166 by a weld 169 using a drive pin welding machine 200, which is described herein. The reed 166 has a first surface 171 and an opposing second surface 173. The drive pin 174 generally extends from the first reed surface 171. However, a first end 179 of the drive pin 174 extends generally through the entirety of the reed 166 passing through the first surface 171 and the body of the reed 166 to the second surface 173. Thus occurs because during the welding operation (described in greater detail herein) a portion of the reed 166 is melted to form a molten material while the feed wire 278 forming the drive pin 174 is pushed into the molten material. In an embodiment, the drive pin 174 may scarcely protrude through the second surface 173 of the reed 166. In alternative embodiments, the first end 179 of the drive pin 174 may be flush with the second surface 173 of the reed 166, or may pass through only a portion of the body of the reed 166 without passing through the second surface 173. The drive pin 174 may be formed with a slight bulbous or ball-shaped end portion 284 on the free end of the drive pin 174 (away from the reed 166). The ball-shaped end portion 284 of the drive pin 174 has a greater diameter than the middle portion of the drive pin 174. In an embodiment, the ball shaped end portion 284 is formed when the drive pin 174 is cut to length by a second laser 264B, the cutting process liquefying a portion of the metal end of the drive pin 174 which thereafter cools and solidifies to form the bulbous ball shaped end portion 284, as described herein.

FIGS. 3-5A depict a drive pin welding machine 200. The drive pin welding machine 200 generally comprises a video monitor 210, a control panel 220, and a welding unit 250.

Figure 3:
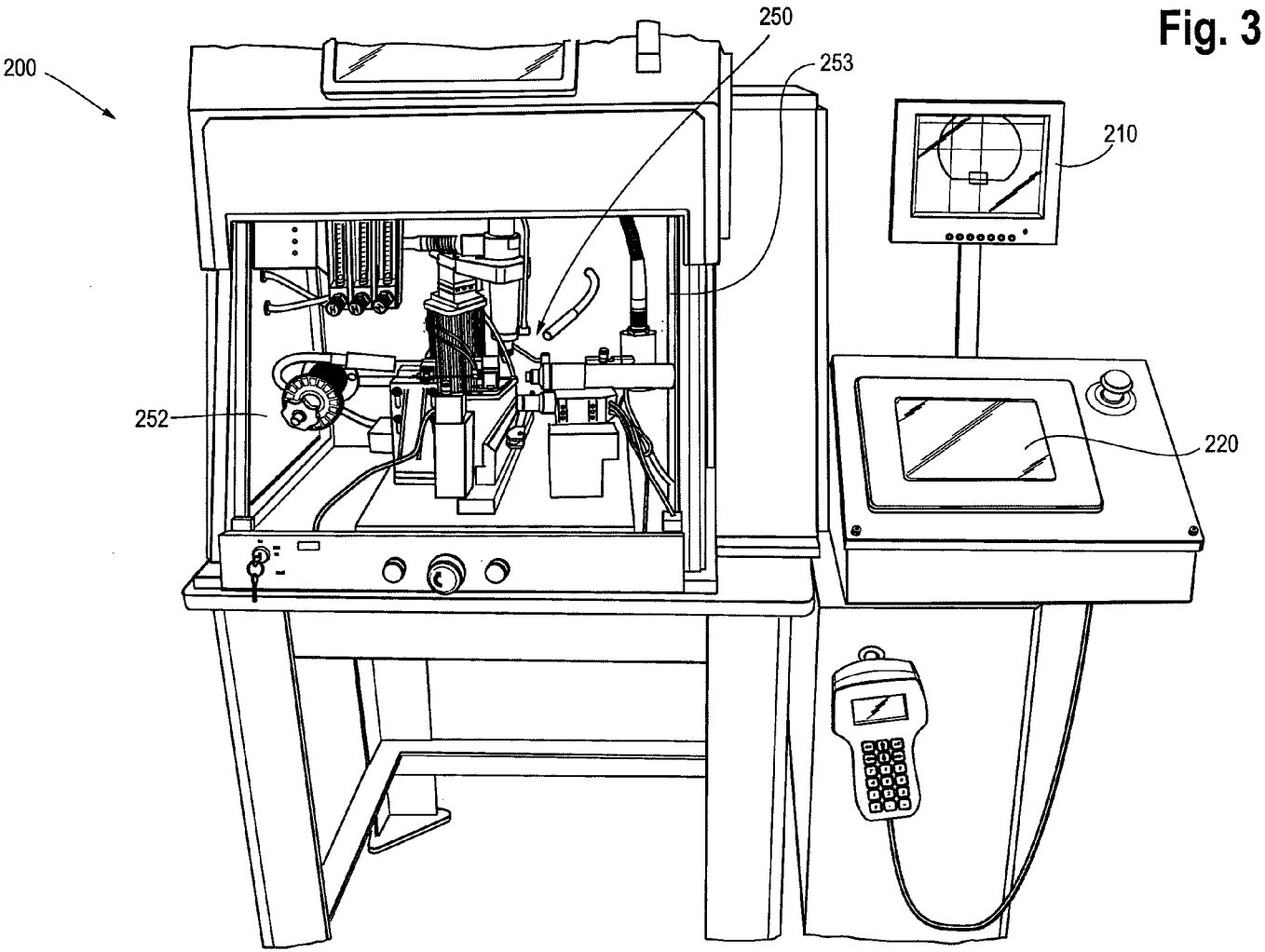
FIG. 3 shows a perspective view of a drive pin welding machine according to an exemplary embodiment.
Figure 4:
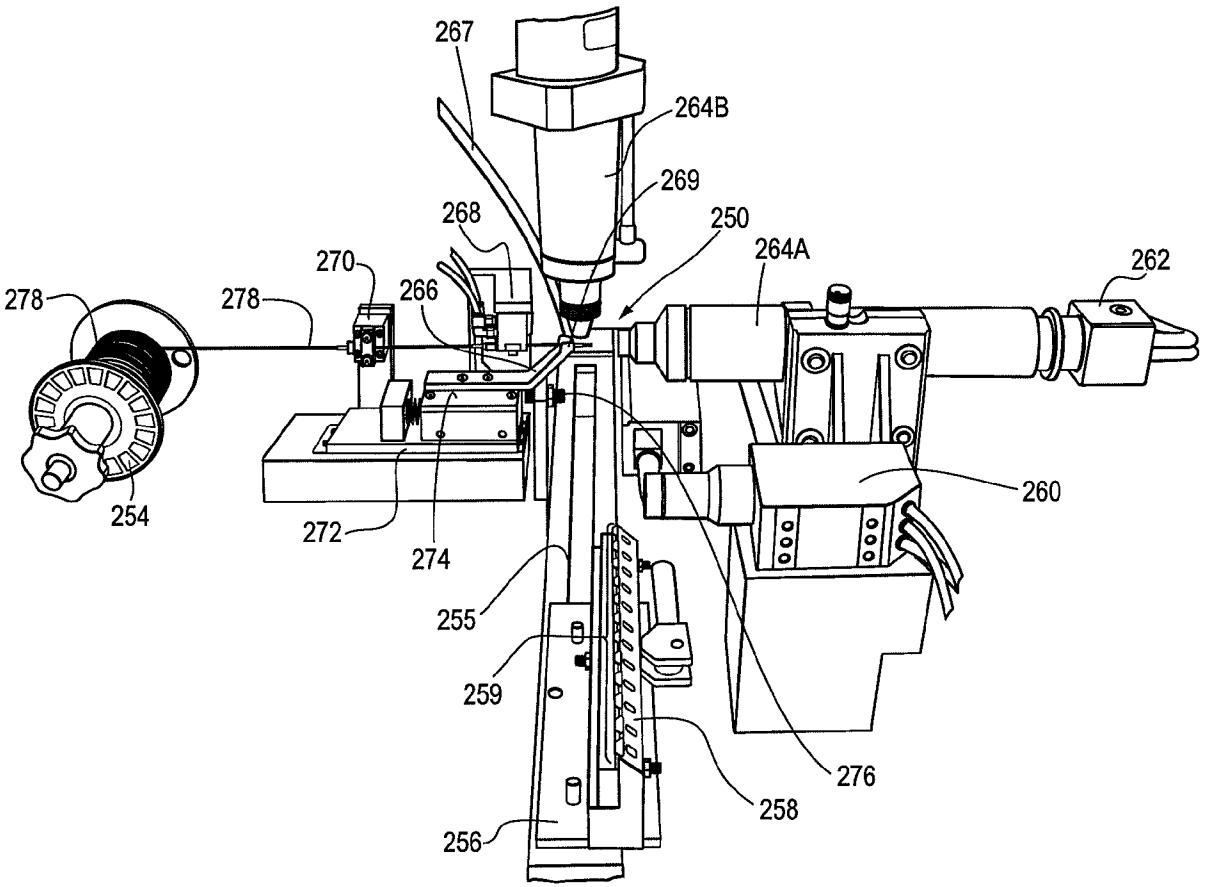
FIG. 4 shows another perspective view of the drive pin welding machine shown in FIG. 3.

The welding unit 250 has a first laser 264A for welding the drive pin 174 to the reed 166 and second laser 264B for cutting the feed wire 278 to form the drive pin 174. As shown in FIG. 4, the welding unit 250 has a wire spool 254 having a supply of feed wire 278, which when affixed and cut to length, forms the drive pin 174. The welding unit 250 also comprises a parts transfer slide 256, which slides in track 255, for moving the armatures into the welding zone and a parts holding fixture 258 having a plurality of nests 259. The welding unit 250 also includes optical viewing equipment, in particular, an optical microscope 260 for determining whether a reed 166 is present in the parts holding fixture 258 and a video camera 262 to create a live image of the reed 166 and drive pin 174 in the welding position and to focus the lasers 264A, 264B. As shown in FIG. 3, the welding unit 250 can also be outfitted with a door 252, which includes a viewing window 253 for outside observation and viewing purposes.

Figure 5A:
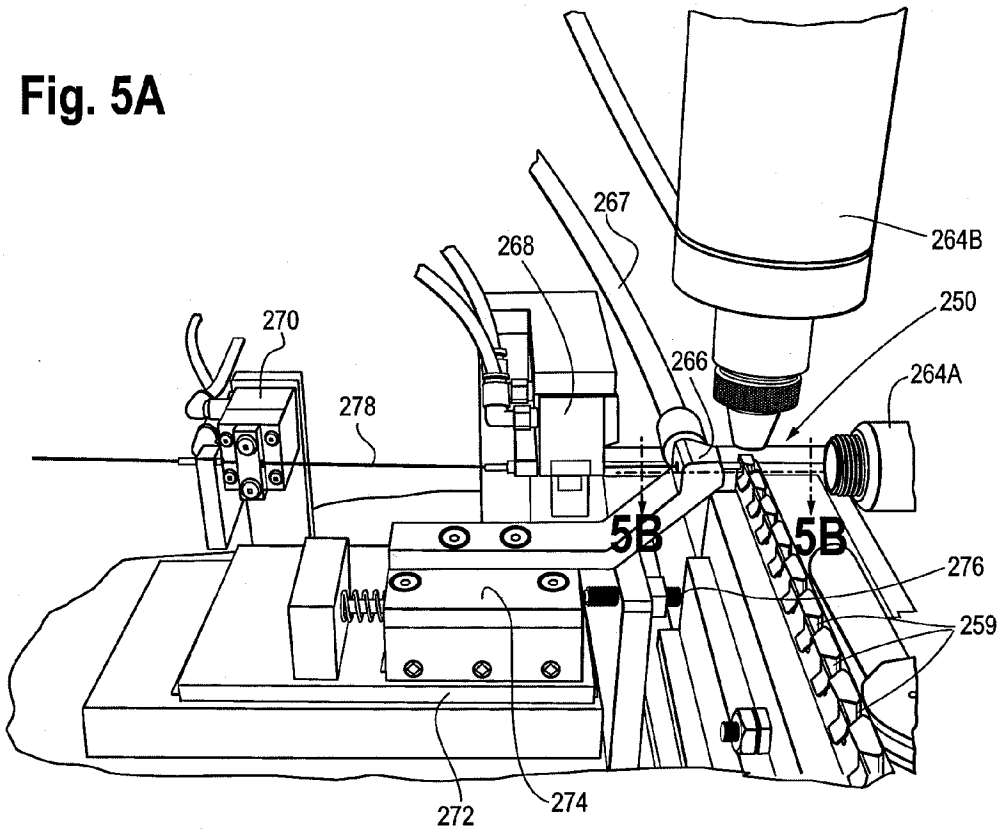
FIG. 5A shows yet another perspective view of the drive pin welding machine shown in FIG. 3.

As shown in FIG. 5A, the welding unit 250 also has a wire guide 266 for properly placing the feed wire 278 on the reed 166, front and back grippers 268, 270 for gripping and selectively advancing the feed wire 278, a main slide 272 and a top slide 274 for advancing the feed wire 278. The rear gripper 270 moves with the main slide 272. The top slide 274 moves with the main slide 272 and also can move relative to main slide 272 in tracks 279 located on the main slide 272 as depicted in FIG. 6B. The wire guide 266 and the front gripper 268 move with the top slide 274. The main slide 272 moves in tracks 281 as shown in FIG. 6B. A front stop 276, which can be formed of a stop screw, limits the movement of the top slide 274, and a stop bracket 273 limits the movement of the main slide 272. Additionally, as shown in FIGS. 6A-6F, the main slide 272 can be provided with a block 277 and spring 275 for limiting backward movement of the top slide 274 on the main slide 272.

The main slide 272 has multiple functions including feeding the drive pin material or feed wire 278, determining the overall travel length of the wire guide 266, and moving the wire guide 266 out of the way from the beam from the second laser 264B during the cutting process.

Figure 5B:
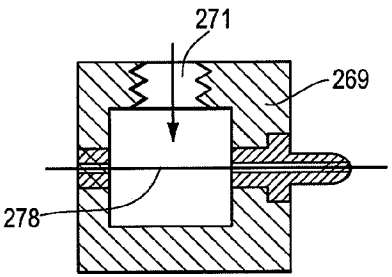
FIG. 5B shows a cross-section of the wire guide shown in FIG. 5A.

The wire guide 266 is integrally formed with a gas distribution fixture 269, which is fed gas from a gas line 267. FIG. 5B depicts a cross-sectional view of the gas distribution fixture 269. Gas distribution fixture 269 has a port 271 for feeding gas to the wire guide 266, which aids in cooling the weld surfaces.

The welding unit 250 is configured to attach the first end 179 of the feed wire 278 to the reed 166 using a laser welding process and then cut the feed wire 278 with a laser to form a drive pin 174, as shown in FIG. 1. In alternative embodiments, this process can be accomplished either manually or automatically.

Figure 6A:
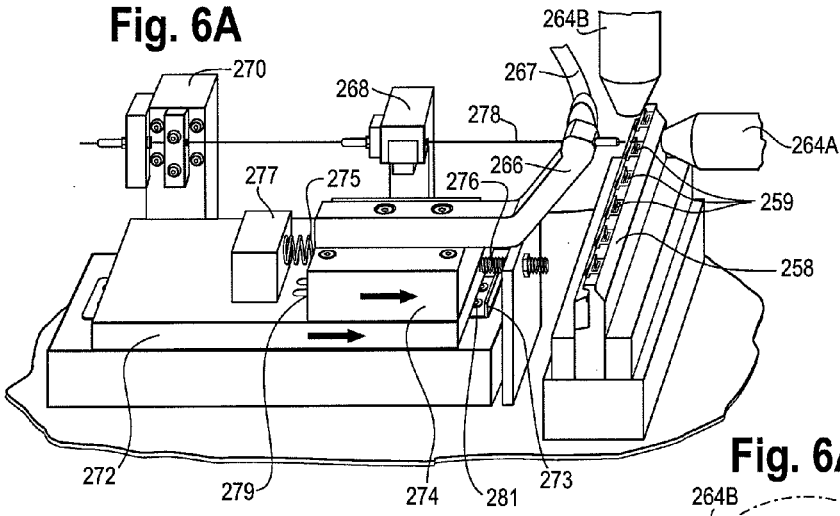
FIGS. 6A-6F show perspective views of an exemplary drive pin forming process.
Figure 6A:
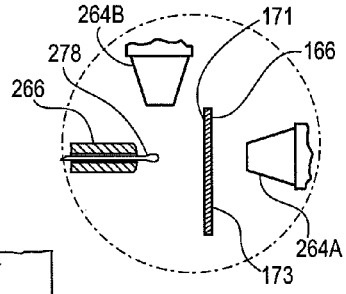
Figure 6B:
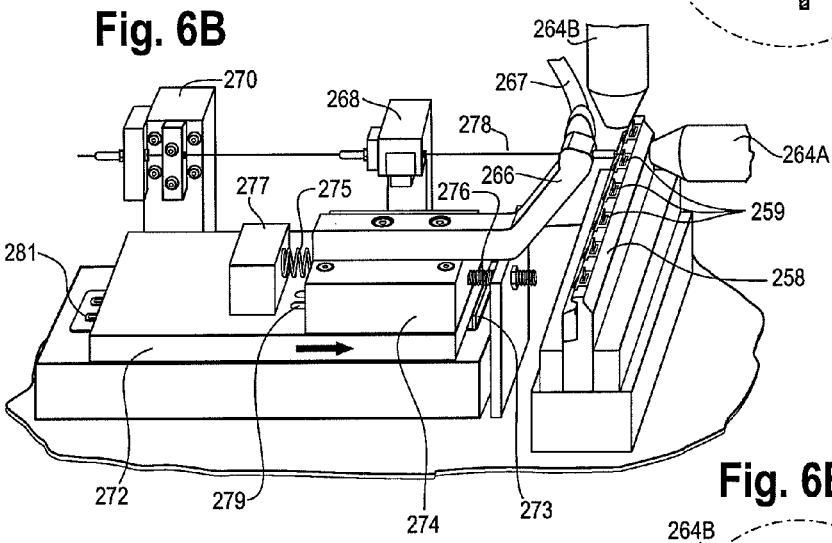
Figure 6B:
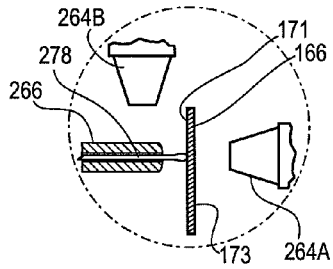
Figure 6C:
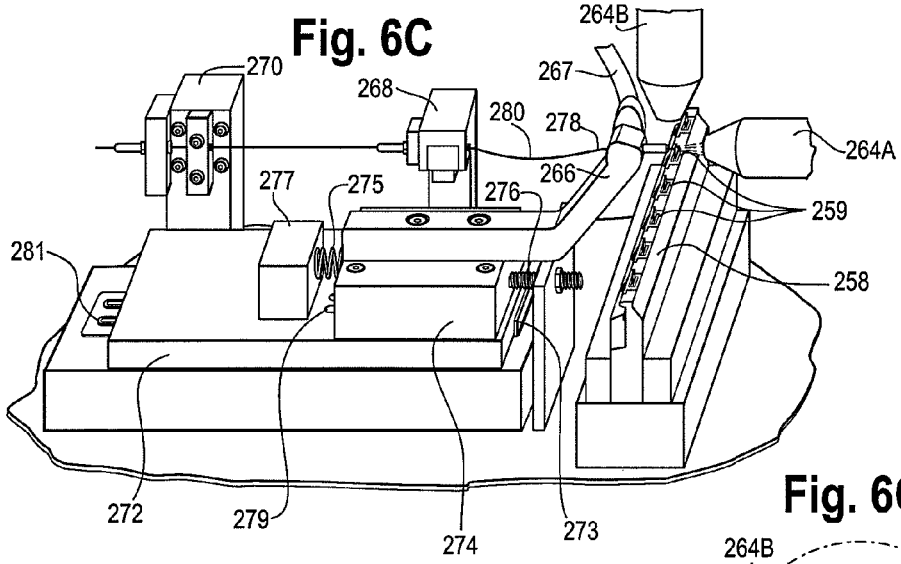
Figure 6C:
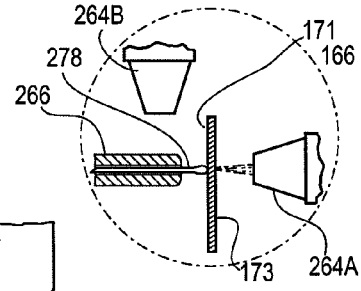

The welding process performed by the machine 200 is depicted in a series of steps shown in FIGS. 6A through 6F and FIGS. 6A1-6D1, and 6F1. As shown in FIG. 6A, to start the welding process, the main slide 272 and the top slide 274 move forward toward the parts holding fixture 258 with the front gripper 268 in a closed position and the back gripper 270 in an open position. The feed wire 278 is thus pulled from the spool 254, which is depicted in FIG. 4, and guided through the wire guide 266. As shown in FIG. 6B, when the top slide 274 comes in contact with the front stop 276, the wire guide 266 motion is stopped. The main slide 272 with the rear gripper 270 in the closed position and the front gripper 268 in the open position will continue to move forward causing the feed wire 278 to be forced up against the reed 166 as shown in FIG. 6B1. The distance between the wire guide 266 and the first reed surface 171 is determined by the position of the front stop screw 276, which can be adjusted. In one embodiment, the stop screw 276 can adjust the distance between the wire guide 266 and the reed surface between 0.026 to 0.028 in. depending on the feed wire 278 material. As shown in FIGS. 6B and 6C, the main slide 272 continues to move forward with the rear gripper 270 in the closed position and the front gripper 268 in the open position causing the reed 166 to put pressure on the feed wire 278, thereby causing it to deflect, resulting in a buckled portion 280 of the feed wire 278. For accurate positioning of the feed wire 278 relative to the reed 166, the wire guide 266 needs to be as close as possible to the first reed surface 171.

The feed wire 278 is forced up against the reed 166 producing an axial force on the feed wire 278 causing the wire to bend, which forms the buckled portion 280. During this step, the feed wire 278 will exert a compression force against the first reed surface 171. The compression force is caused by the deflection in the buckled portion 280 of the feed wire 278, which, being resilient, has a tendency to reflex or "snap back" to its straight position.

Also shown in FIGS. 6C and 6C1, the first laser 264A produces a laser beam that is applied to the second reed surface 173 at a welding spot and the laser energy melts and partially liquefies the reed 166 material. The center of the feed wire 278 is located in the center of the welding spot. By applying the first laser 264A beam on the second reed surface 173 or on the opposite side of the feed wire 278, the reed 166 itself creates a protective shield for the feed wire 278 to prevent it from melting. Additionally, the laser parameters can be optimized in such a way that only the reed 166 material is melted.

Figure 6D:
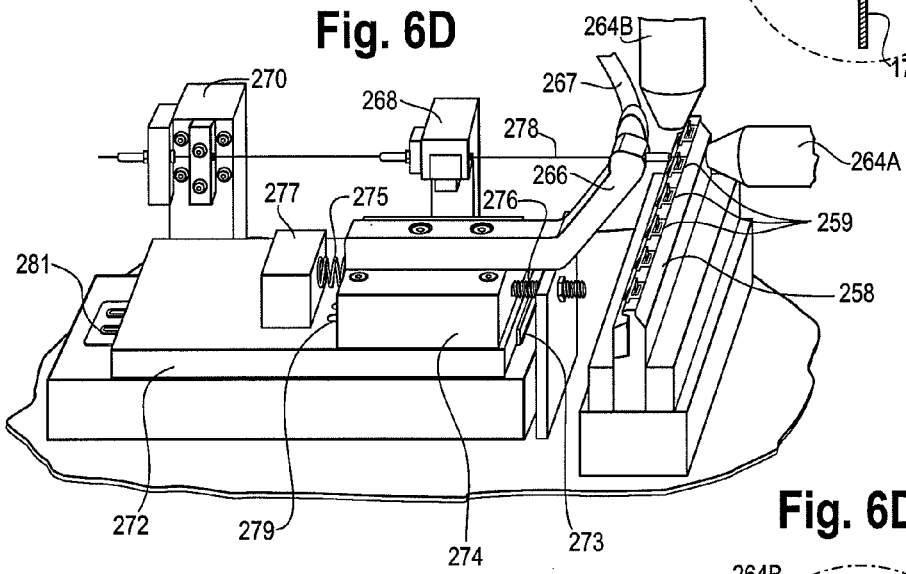
Figure 6D:
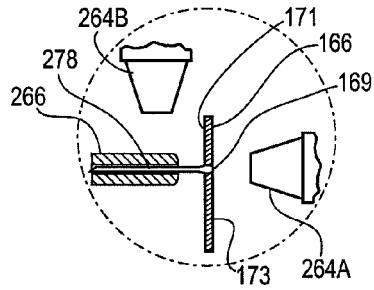

As shown in FIGS. 6D and 6D1, the feed wire 278 is directed in the same spot where the reed 166 melting occurs and the axial compression force on the wire causes the feed wire 278 to be fed into molten area to form the weld 169. Stated differently, the reflex action of the buckled portion 280 of the feed wire 278 causes the first end 179 of the feed wire 278 to pass through the first surface 171 of the reed 166, and into the temporarily liquefied portion of the body of the reed 166. As the feed wire 278 is pushed into the molten area, the buckled portion 280 in the feed wire 278 is relieved to form a straight wire as shown in FIG. 6D. After solidification of the molten area, the feed wire 278 is captured in the reed material, and the result is a robust weld 169 between the reed 166 and the feed wire 278. After the feed wire 278 is captured in the reed 166, the first end 179 of the feed wire 278 will extend through the first surface 171 of the reed, and may protrude slightly from the second surface 173 of the reed 166. The pulse duration of the first laser 264A parameters can be set very short to cause the molten reed 166 to become solidified after a short period of time.

Figure 6E:
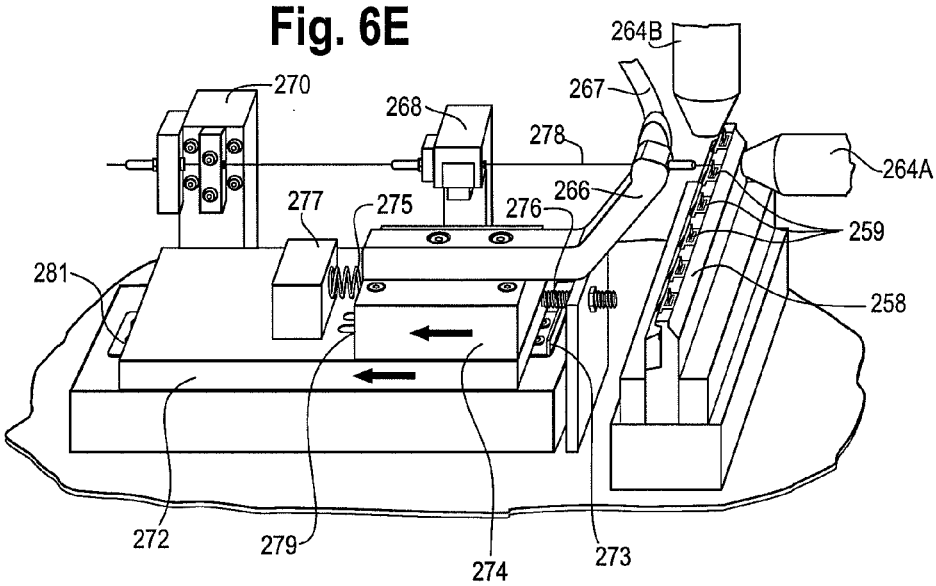

To cut the feed wire 278 as shown in FIG. 6E, the main slide 272 retracts, with the front gripper 268 in the open position and the back gripper 270 in the open position, causing the top slide 274 and the wire guide 266 to retract. This process ensures that the wire guide 266 is moved out of the way of the second laser 264B beam before firing the second laser 264B beam.

Figure 6F:
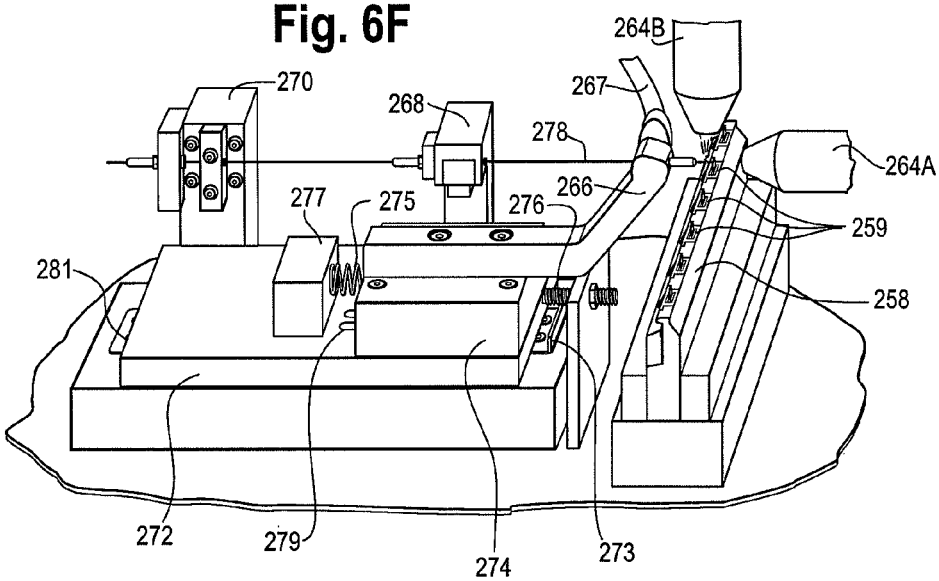
Figure 6F:
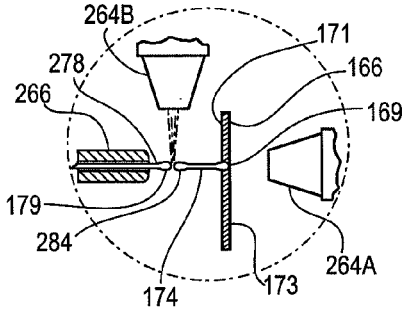

Next, as depicted in FIGS. 6F and 6F1, the second laser 264B emits a laser pulse to cut the feed wire 278 to form the drive pin 174. The feed wire 278 is then cut at a predetermined location adjacent to the second laser 264B to form the drive pin 174 by cutting it to a desired length.

As shown in FIG. 6F1, as the second laser 164B cuts the feed wire 278, a bulbous or ball-shaped end portion 284 is formed on the second end of the drive pin 174, and a bulbous or ball-shaped portion is also formed on the end of the next portion of the feed wire 278 which forms the first end 179 of the next drive pin 174. The ball-shaped end portion 284 is somewhat larger in diameter than the average overall drive pin diameter, on both ends of the drive pin 174. Compared to a mechanically sheared drive pin, which has no protuberance, the ball-shaped end portion 284 has a larger surface area for contacting adhesive, thus creating a better glue joint connection between the paddle 152 and the drive pin 174. Because the glue forms a socket 285, as depicted in FIG. 1D, around the ball-shaped end portion 284 of the drive pin 174, a stronger "ball and socket" glue joint is formed, that is less susceptible to mechanical hysteresis.

After cutting the feed wire 278 to form the drive pin 174, the parts holding fixture 258 then moves back so that the optical microscope 260 can provide images of the reed 166 position in the parts holding fixture 258 for the next part. If a reed is "found" by the optical microscope 260, the welding sequence discussed above will start over again. If no part is loaded in a particular nest 259, the slide will move to the next part. This operation will continue until parts from all loaded nests 259 have drive pins 174 cut and welded to the reeds 166. After completing welds 169 and cuts for all of the motor assemblies located in nests 259, the parts holding fixture 258 automatically moves to re-loading position, and the door 252 is manually opened. The motor assemblies 150 can then be removed and each of the corresponding ball shaped end portions 284 of the drive pins 174 can be glued to a corresponding paddle 152.

Alternatively, the drive pin welding machine 200 can be operated in manual mode. The operator can move the parts holding fixture 258 by moving the parts transfer slide 256 manually. The user moves the parts transfer slide 256 and the parts holding fixture 258 in front of the optical microscope 260. Once the reed 166 position is sensed by the optical microscope 260, the parts transfer slide 256 is stopped and the drive pin welding machine 250 can commence welding the feed wire 278 to the reed 166 and cutting the feed wire 278 to form the pin 174, as described previously herein.

The optical microscope 260 provides a live picture of the welding operation, which is displayed on the video monitor 210. The correct reed position is monitored by the video monitor 210 and may be compared to a coordinate system generated by a cross hair generator.

In an embodiment, inert gas "Argon" can be projected onto the welding surfaces during the welding process. Projecting the inert gas onto the surfaces aids in preventing oxidation, minimizing drive pin 174 heating, and reducing the size of the heat-affected zone on the reed. The gas distribution fixture 269 directs the inert gas flow to the welding surfaces.

To create durable weld joints, the welding parameters must be set properly. The laser parameters are defined in a way that only the reed surface in contact with the feed wire 278 is melted and the feed wire 278 is fed into the molten material. To accomplish this: (1) the laser parameters, such as the spot size, peak power, and pulsing width need to be determined as a function of the reed and wire/drive pin materials; (2) the drive pin and the reed material must be protected from large amounts of heat, which can be accomplished through inert gas flow, and (3) the laser pulse must be set short, preferably 1 to 2 milliseconds.

In an embodiment, a LaSag laser power supply is used for generating the welding energy used in the described welding and cutting processes. The laser beams can be delivered through fiber optics cables to processing heads. The processing head can have a lens with a 100 mm focal distance. The reed 166 welding surface must be placed in the focal point of the lens. A lens with a longer focal length has two advantages: (1) it allows for a greater distance for positioning of the reed and (2) it is easier to protect the lens from welding material splattering from the reed. In addition, easy-to-change glass plates can be used to provide lens protection. As discussed above, the laser parameters are selected as a function of the material and the weld joint properties. The laser's parameters have a direct effect over the weld joint quality, laser spot size, and laser penetration depth. In an embodiment, welding laser parameters are: frequency level=2 Hz, laser power=1410 W, and laser pulse duration=1.2 milliseconds. In another embodiment, the feed wire 278 is made from stainless steel 302 alloy, with a diameter of 0.004 inch and drive pin cutting laser parameters are: frequency level=2 Hz, laser power level=400 W, and pulse duration=3 milliseconds.

The welding machine sequence can be controlled by a programmable logic controller ("PLC"). The PLC can be interfaced with the lasers 264A, 264B, with a suitable connector, such as an X51 connector. Additionally, the lasers 264A and 264B can be any type of suitable laser such as a LaSag laser. For welding and cutting the drive pin two different welding programs or "recipes" can be used.

For the welding and cutting process a time sharing dual fiber laser system can be used, where the PLC can switch the laser power supply from the first laser 264A to the second laser 264B. Time sharing between the two fibers allows the lasers to fire separately and independently. The PLC is connected to the fibers and according to the desired function instructs the fibers to fire the lasers to cause the welding or cutting operation. In conjunction with selecting the correct fiber, the PLC performs a program change or "recipe change" to alter the laser parameters such as from welding to cutting. For example, the welding function and the cutting function may differ from each other by pulse duration and power intensity. It is also contemplated that the above could be accomplished using separate power sources for the lasers 264A and 264B.

Aspects of the invention have been described in terms of illustrative embodiments thereof. Numerous other embodiments, modifications and variations within the scope and spirit of the disclosed invention will occur to persons of ordinary skill in the art from a review of this entire disclosure. For example, one of ordinary skill in the art will appreciate that the steps illustrated in the illustrative figures may be performed in other than the recited order, and that one or more steps illustrated may be optional in accordance with aspects of the disclosure.

What is claimed is:

1. A method of forming a balanced armature transducer assembly comprising:

locating a feed wire for forming a drive pin on a reed at a wire contact point on a first surface of the reed;

welding a first end of the feed wire to the reed by a laser welding operation with a first laser, wherein the first laser is directed at a second surface of the reed opposite the wire contact point;

cutting the feed wire to form a drive pin; and securing the drive pin to a paddle.

2. The method of claim 1 wherein the feed wire is compressed against the reed to form a buckled portion in the feed wire.

3. The method of claim 1 wherein the first laser melts a portion of the reed to form a molten reed material and the feed wire is pushed through the molten reed material to form a weld between the feed wire and the reed once the molten reed material solidifies.

4. The method of claim 1 wherein the step of cutting the feed wire to form a drive pin comprises cutting the feed wire with a second laser, wherein the second laser forms a bulbous end on the drive pin.

5. The method of claim 4 wherein securing the drive pin to the paddle comprises adhering the bulbous end of the drive pin to the paddle with an adhesive, and wherein the adhesive forms a socket which receives the bulbous end.

6. A method of forming a balanced armature transducer assembly comprising:

locating a feed wire for forming a drive pin on a reed by contacting the reed with the feed wire;

laser-welding a first end of the feed wire to the reed with a first laser wherein the reed creates a protective shield for the feed wire to prevent the feed wire from melting and the first laser melts a portion of the reed to form a molten reed material and the feed wire is advanced through the molten reed material to form a weld between the feed wire and the reed upon solidification of the molten reed material;

laser-cutting the feed wire to form a drive pin with a second laser; and adhering the drive pin to a paddle.

7. The method of claim 6 wherein the feed wire is compressed against the reed to form a buckled portion in the feed wire.

8. The method of claim 6 wherein the feed wire contacts the reed on a first reed surface and the first laser is directed at a second reed surface opposite the first reed surface.

9. The method of claim 6 wherein the second laser forms a bulbous end portion on the drive pin.

10. The method of claim 9 wherein the bulbous end portion of the drive pin is adhered to the paddle with an adhesive and the adhesive forms a socket around the bulbous end portion.

11. A method of forming a drive pin onto a reed of a balanced armature transducer comprising:

placing a feed wire in contact with a reed at a wire contact point;

directing a heat source at the reed to liquefy a portion of the reed adjacent the wire contact point and wherein the reed creates a protective shield for the feed wire to prevent the feed wire from melting;

advancing the feed wire into the molten material on the reed; and solidifying the liquefied portion of the reed to form a weld between the reed and the feed wire.

12. The method according to claim 11 further comprising cutting the feed wire to form a drive pin having a cut end.

13. The method according to claim 12 further comprising gluing the cut end of the drive pin to a paddle to form a connection between the reed and the paddle via the drive pin.

* * * * *